US008636088B2

(12) United States Patent
Muuttonen et al.

(10) Patent No.: US 8,636,088 B2
(45) Date of Patent: Jan. 28, 2014

(54) ROCK DRILLING MACHINE AND AXIAL BEARING MODULE

(75) Inventors: Timo Muuttonen, Siuro (FI); Lars Kandelin, Tampere (FI); Pekka Saukko, Tottijärvi (FI)

(73) Assignee: Sandvik Mining and Construction Oy, Tampere (FI)

( * ) Notice: Subject to any disclaimer, the term of this patent is extended or adjusted under 35 U.S.C. 154(b) by 340 days.

(21) Appl. No.: 13/130,268

(22) PCT Filed: Nov. 17, 2009

(86) PCT No.: PCT/FI2009/050924

§ 371 (c)(1),
(2), (4) Date: May 19, 2011

(87) PCT Pub. No.: WO2010/058072

PCT Pub. Date: May 27, 2010

(65) Prior Publication Data

US 2011/0220421 A1 Sep. 15, 2011

(30) Foreign Application Priority Data

Nov. 20, 2008 (FI) ..... 20086097

(51) Int. Cl.
*E21B 4/00* (2006.01)

(52) U.S. Cl.
USPC ..... 175/293; 175/405; 175/414; 384/517; 173/210; 173/114; 173/112

(58) Field of Classification Search
USPC ..... 175/372, 296, 27, 293, 405, 414; 384/517; 173/210, 112, 114
See application file for complete search history.

(56) References Cited

U.S. PATENT DOCUMENTS

| | | | | |
|---|---|---|---|---|
| 5,351,763 | A | 10/1994 | Muuttonen | |
| 5,771,982 | A | 6/1998 | Briggs et al. | |
| 6,186,246 | B1 | 2/2001 | Muuttonen et al. | |
| 6,273,199 | B1 | 8/2001 | Kiikka et al. | |
| 6,705,407 | B2 | 3/2004 | Heinonen et al. | |
| 7,419,015 | B2 | 9/2008 | Muuttonen et al. | |
| 2005/0016774 | A1 | 1/2005 | Comarmond | |
| 2006/0213690 | A1 * | 9/2006 | Muuttonen et al. | 175/296 |
| 2011/0240322 | A1 | 10/2011 | Kandelin et al. | |

FOREIGN PATENT DOCUMENTS

| | | |
|---|---|---|
| AU | 7217996 | 4/1997 |
| CN | 1201864 | 12/1998 |
| CN | 2360606 | 1/2000 |
| CN | 1210485 | 7/2005 |

(Continued)

OTHER PUBLICATIONS

Search Report issued Sep. 4, 2009 in corresponding Finnish Patent Application No. 20086097 (In Finnish).

(Continued)

*Primary Examiner* — Yong-Suk (Philip) Ro
(74) *Attorney, Agent, or Firm* — Morgan, Lewis & Bockius LLP

(57) ABSTRACT

A rock drilling machine and an axial bearing module. The rock drilling machine is equipped with an axial bearing having at least one axial piston for axially positioning a drill shank and for damping stress pulses returning from the rock. The axial bearing includes a module that is detachable in one piece from one installation direction. The axial bearing module includes the required pressure medium channels, seals, bearing surfaces, and a module frame having at least bearing housing in connection therewith.

21 Claims, 10 Drawing Sheets

(56) References Cited

FOREIGN PATENT DOCUMENTS

| | | | |
|---|---|---|---|
| CN | 1735486 | | 2/2006 |
| CN | 1774317 | | 5/2006 |
| EP | 1 160 416 | A2 | 12/2001 |
| FI | 75028 | C | 4/1988 |
| FI | 84701 | | 9/1991 |
| FI | 108668 | B | 2/2002 |
| FI | 20030016 | A | 7/2004 |
| FR | 2 761 112 | | 9/1998 |
| JP | 8-511842 | | 12/1996 |
| JP | 2006-512217 | | 4/2006 |
| WO | WO 94/24403 | | 10/1994 |
| WO | WO 01/02691 | | 1/2001 |
| WO | WO 01/83170 | A1 | 11/2001 |
| WO | WO 03/078107 | | 9/2003 |
| WO | WO 2004/060617 | A1 | 7/2004 |
| WO | WO 2004/080661 | | 9/2004 |
| WO | WO 2005/087444 | A1 | 9/2005 |
| WO | WO 2007/073275 | | 6/2007 |

OTHER PUBLICATIONS

Office Action issued Sep. 9, 2009 in corresponding Finnish Patent Application No. 20086097 (In Finnish).

International Search Report mailed Feb. 26, 2010, issued in PCT/FI2009/050924.

Notice of Grounds for Rejection, with English translation, for Korean Application No. 2011-7013843, dated Apr. 29, 2013.

Notification of the First Office Action (with English translation) for Chinese Application No. 200980146556.9, dated Apr. 28, 2013.

Extended European Search Report for European Application No. 09827227.1, dated Aug. 26, 2013.

* cited by examiner

ROCK DRILLING MACHINE AND AXIAL BEARING MODULE

CROSS REFERENCE TO RELATED APPLICATIONS

This application is the National Stage of International Application No. PCT/FI2009/050924, filed Nov. 17, 2009, and claims benefit of Finnish Application No. 20086097 filed Nov. 20, 2008, both of which are herein incorporated by reference in their entirety.

BACKGROUND OF THE INVENTION

The invention relates to a rock drilling machine that comprises a body, a percussion element arranged inside the body and, further, a drill shank, to which a tool may be attached for breaking rock. A percussion device comprises a percussion element that generates stress pulses through the shank to the tool. Further, the rock drilling machine comprises an axial bearing having one or more pressure medium-operated axial pistons, with which the shank may be pushed in the axial direction relative to the body a predefined travelling length toward the stroke direction. The impact surface of the shank may then be set at a required axial point for receiving stress pulses. The axial piston is operated by pressure medium, whereby it comprises a working pressure surface that is located in a working pressure space belonging to the axial bearing, to which the pressure of the pressure medium may be fed from a feed channel. A force may then be directed to the axial piston in the stroke direction.

Further, the invention relates to an axial bearing module of the rock drilling machine, which comprises one or more pressure medium-operated axial pistons.

The field of the invention is defined in more detail in the preambles of the independent claims of the patent application.

It is known to equip a rock drilling machine with an axial bearing, with which a drill shank belonging to the rock drilling machine may be moved to a planned impact point during drilling. The striking power may then be adjusted by adjusting the position of the drill shank. In addition, the axial bearing may be used to damp the stress pulses reflected back to the rock drilling machine from the rock. The axial bearing is typically positioned in an intermediate flange between the front body and back body of the rock drilling machine. A drawback with the known axial bearings is that their maintenance is complex and slow. Further, the assembly of the axial bearing and a possible later replacement of components is difficult. Yet another detected problem with axial bearing solutions is that the supporting forces caused by the operation of the axial bearing cause unnecessary strain on the structures of the rock drilling machine.

BRIEF DESCRIPTION OF THE INVENTION

It is an object of the invention to provide a novel and improved rock drilling machine and axial bearing module.

The rock drilling machine of the invention is characterised in that the axial bearing comprises at least one axial bearing module that comprises at least one axial piston, at least one seal, at least one bearing surface, and a module frame; that the axial bearing module is detachable and mountable in place in one piece without needing to dismantle the body of the rock drilling machine; and that in connection with the axial bearing, there is at least one set of support means for transmitting the supporting forces caused by the axial bearing to the body of the rock drilling machine without any force effects directed to the flushing chamber.

The axial bearing module of the invention is characterised in that the axial bearing module comprises at least one axial piston, at least one seal, at least one bearing surface, and a module frame; that the module frame comprises at least one set of support members for fastening the axial bearing module independently to the rock drilling machine; and that the axial bearing module is a uniform piece that is detachable and mountable in place in the rock drilling machine in one piece.

The idea of the invention is that the axial bearing of the rock drilling machine comprises one or more axial bearing modules that are detachable and mountable in place in the space in the body in one piece. The axial bearing module comprises one or more axial pistons, one or more bearing surfaces, and a module frame. The module frame is furnished with the necessary support members for fastening it independently to the rock drilling machine. The module also has the necessary seals. Further, the supporting forces caused by the operation of the axial bearing are transmitted to the body of the rock drilling machine with suitable support means and surfaces so that the supporting forces are not transmitted through the flushing chamber in the front part of the rock drilling machine. Further, an idea is that the axial bearing module is arranged in place without having to dismantle the body or parts thereof.

The invention provides the advantage that the axial bearing module comprises in one uniform entity all essential components necessary for the operation of the axial bearing. The axial bearing module may conveniently be detached in one entity and replaced by a new one. Further, worn seals and possibly also bearings may be detached and replaced in the repair shop in good conditions. When the supporting forces of the axial bearing are transmitted to the body by using means arranged to the axial bearing, the supporting forces will not strain the flushing chamber, and the structure of the flushing chamber need not be designed on the basis of the supporting forces. The structure of the flushing chamber may then be lighter and smaller in size, which facilitates its detachment and installation when changing the drill shank. In addition, extra strain from the supporting forces is not directed to the joint surfaces of the flushing chamber and the flushing chamber remains tight. When the strains directed to the critical front end of the rock drilling machine are reduced, the strength and reliability of the rock drilling machine improve. Further, because the body of the rock drilling machine need not be dismantled when installing the axial bearing module, minor maintenance, component replacements, and other repairs of the axial bearing may be done on site and without needing to detach the rock drilling machine from the feed beam.

The idea of an embodiment is that the axial bearing module is arranged in place from the front end of the rock drilling machine without dismantling the body.

The idea of an embodiment is that the axial bearing module is arranged in place from the back end of the rock drilling machine without dismantling the body.

The idea of an embodiment is that the axial bearing module comprises at least one sleeve-like axial piston.

The idea of an embodiment is that the axial bearing module comprises only one axial piston.

The idea of an embodiment is that the axial bearing module comprises two axial pistons having different travelling lengths in the axial direction.

The idea of an embodiment is that the body of the rock drilling machine is, at least at the axial bearing, a uniform piece without joint surfaces. If the body is made up of several pieces joined at seams, the seams are positioned in such a manner that no supporting forces caused by the operation of the axial bearing are directed to them.

The idea of an embodiment is that the body of the rock drilling machine is one uniform piece with no joint surfaces. A flushing chamber possibly located at the front end of the body and a back cover or pressure accumulator at the back end are not part of the body. A one-piece body does not have joint surfaces and tie bolts between parts thereof, to which loads are directed by the supporting forces caused by the axial bearing. A one-body rock drilling machine may thus be stronger and more maintenance-free than before. In addition, it may be lighter and shorter.

The idea of an embodiment is that one or more axial bearing modules are fastened to the body of the rock drilling machine by means of one or more form-locking members. The form-locking member may transmit supporting forces from the axial bearing module to the body.

The idea of an embodiment is that one or more axial bearing modules are fastened to the body of the rock drilling machine by means of bayonet fastening.

The idea of an embodiment is that at least one axial bearing module is furnished with at least one support surface, support shoulder, support flange or a corresponding member, with which the supporting forces caused by the operation of the axial bearing may be transmitted directly to the body of the rock drilling machine.

The idea of an embodiment is that the axial bearing comprises two consecutive axial bearing modules.

The idea of an embodiment is that the axial bearing comprises at least two consecutive axial bearing modules, of which the module closest to the front end of the rock drilling machine is arranged to lock the other modules in place in the axial direction.

The idea of an embodiment is that the rock drilling machine comprises a percussion device module that is detachable in one piece from the rock drilling machine. The percussion device module comprises a percussion module frame, percussion member, pressure channels, seals, bearing surfaces, and possible bearing housings, or at least some of the above that are required by the operation of the percussion device. Due to the modular structure, the wearing parts of the percussion device are easy and quick to replace. The percussion device module may conveniently be replaced by a new module, and new seals and bearings may be changed to a detached percussion device module at the repair shop in good conditions. Further, it is possible to change into the rock drilling machine percussion device modules having slightly different operations and properties for different applications and work sites.

The idea of an embodiment is that both the axial bearing module and the percussion device module are replaceable via the back end of the rock drilling machine after the back cover or corresponding back component of the rock drilling machine has been opened. The maintenance of such a rock drilling machine is especially quick and convenient. The shank and flushing chamber need not be removed, and the gear system need not be dismantled.

The idea of an embodiment of the invention is that the axial bearing module and percussion device module are arranged one after the other in the axial direction so that the axial bearing module is naturally close to the front end of the rock drilling machine and the percussion device module is close to the back end. Between the axial bearing module and percussion device module, there may be an axial-direction pressure medium channel or channel section, in which case there is an axial seal between the modules at least at the location of the pressure medium channel. When the modules are installed consecutively inside the body, the one or more axial pressure-medium channels meet and the axial seals seal the joint surfaces of the channels without requiring any special action.

The idea of an embodiment is that one or more feed channels leading to the axial bearing module comprise interconnecting axial-direction sections at least at the point of contact between the axial bearing module and rock drilling machine body. At the point of contact, there are axial seals at the axial-direction feed channel. Due to the axial seals, it is easier to install in place and detach the axial bearing module than when using radial seals. In addition, the axial-direction seals will not be damaged during installation.

The idea of an embodiment is that at the point of contact between the axial bearing module and the rock drilling machine body, there are axial seals at the connecting points of the feed channel, and that the axial bearing module is equipped with at least one pressure surface, to which pressure medium is arranged to be led to generate an axial force acting towards the percussion device. This axial force pushes the axial bearing module against the body of the rock drilling machine, whereby the axial seal at the point of contact between the module and body is arranged to compress between the axial bearing module and body and is, thus, arranged to seal the feed channel at the point of contact. This way, it is possible to ensure the tightness of the pressure medium channel leading to the axial bearing module, when the rock drilling machine is pressurised.

The idea of an embodiment is that at the point of contact between the axial bearing module and rock drilling machine body, there are axial bearings at the connecting points of the feed channel, and that the axial bearing module is equipped with pretension means to keep said axial seals continuously compressed at the point of contact. The pretension means may be for instance a set screw, spring, compressible elastic material, such as an o-ring, or any other axial spring element producing the required force. With the pretension means, it is possible to ensure that the pressure medium channel leading to the axial bearing module remains tight even when the rock drilling machine is not pressurised.

BRIEF DESCRIPTION OF FIGURES

Some embodiments of the invention are described in greater detail in the attached drawings, in which.

In the figures, some embodiments of the invention are shown simplified for the sake of clarity. Similar parts are marked with the same reference numbers in the figures.

DETAILED DESCRIPTION OF SOME EMBODIMENTS OF THE INVENTION

Figure 1:
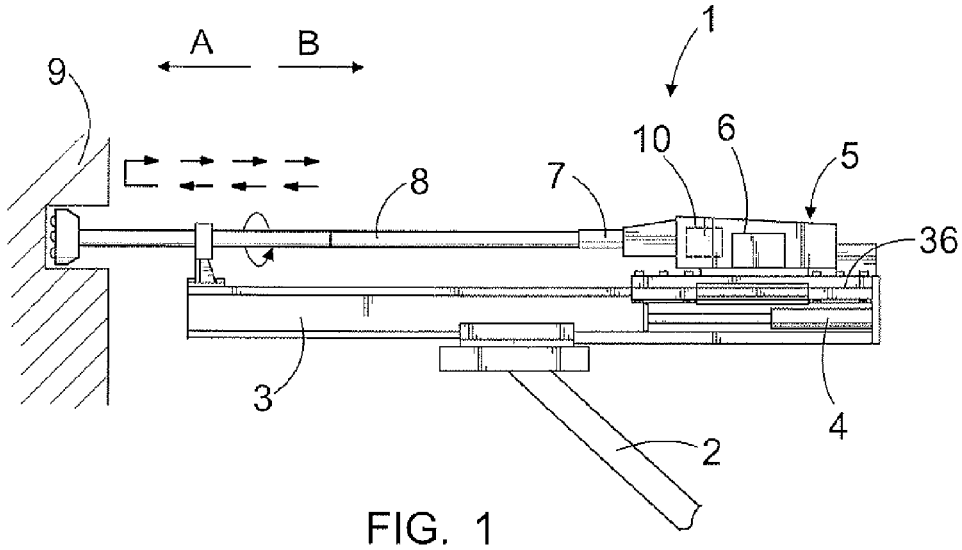
FIG. 1 is a schematic side representation of a rock drilling unit arranged on a drilling boom.

FIG. 1 shows a rock drilling unit 1 that may be arranged on the drilling boom 2 or the like of a rock drilling rig. The rock drilling unit 1 may comprise a feed beam 3, on which a rock drilling machine 5 is arranged and moved by means of a feed device 4. The rock drilling machine 5 may be fastened to a carriage 36 and may be moved in the stroke direction A and return direction B. In addition, the rock drilling machine 5 comprises a percussion device 6 for generating impact pulses to a drill shank 7 and further through a tool 8 to the rock 9. The tool 8 may comprise one or more drill rods and a drill bit. Alternatively, the tool 8 may be an integral rod, in which case a machine member like the drill shank 7 may be thought to be fixedly connected to its rock drilling machine side end. Thus, a drill shank in this patent application may also refer to the back end of an integral rod or the like, on which the axial bearing may act. Further, the rock drilling machine 5 may comprise a rotating device 10 for rotating the drill shank 7 and tool 8 around its longitudinal axis. The drill shank 7 is arranged to transmit impact, rotation and feed forces to the drilling tooling that transmits them on to the rock 9 being drilled.

The percussion device 6 may comprise a percussion piston that is moved back and forth by means of a pressure medium and is arranged to strike in the stroke direction A the impact surface on the drill shank 7. Instead of the percussion piston, it is possible to use any other percussion member or element for generating impact pulses. Impact pulses need not necessarily be generated from kinetic energy, but they may also be generated directly from pressure energy, for example. Further, instead of pressure energy, the energy required for generating impact pulses may also be some other energy, such as electric energy. Thus, it may be stated that the structure and operational principle of the percussion device are not essential issues for the invention being discussed.

Figure 2:
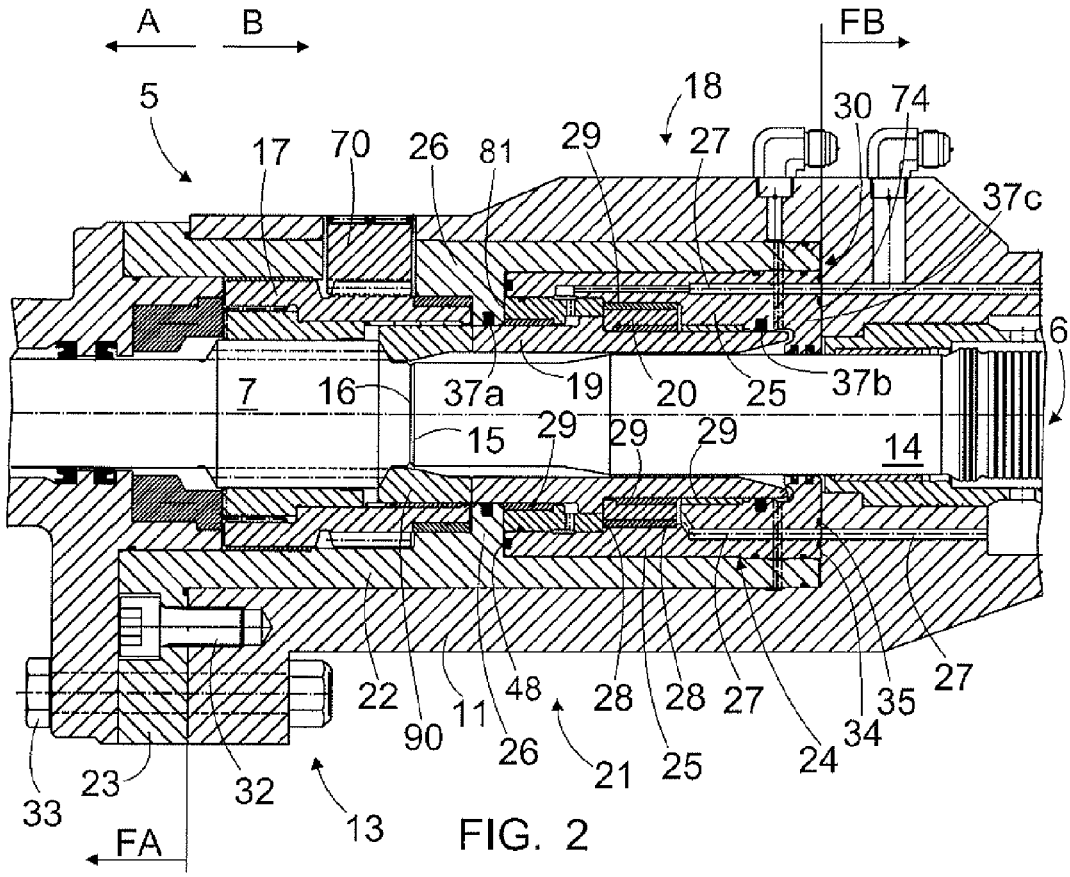
FIG. 2 is a schematic sectional representation of a part of the rock drilling machine according to FIG. 3.
Figure 3:
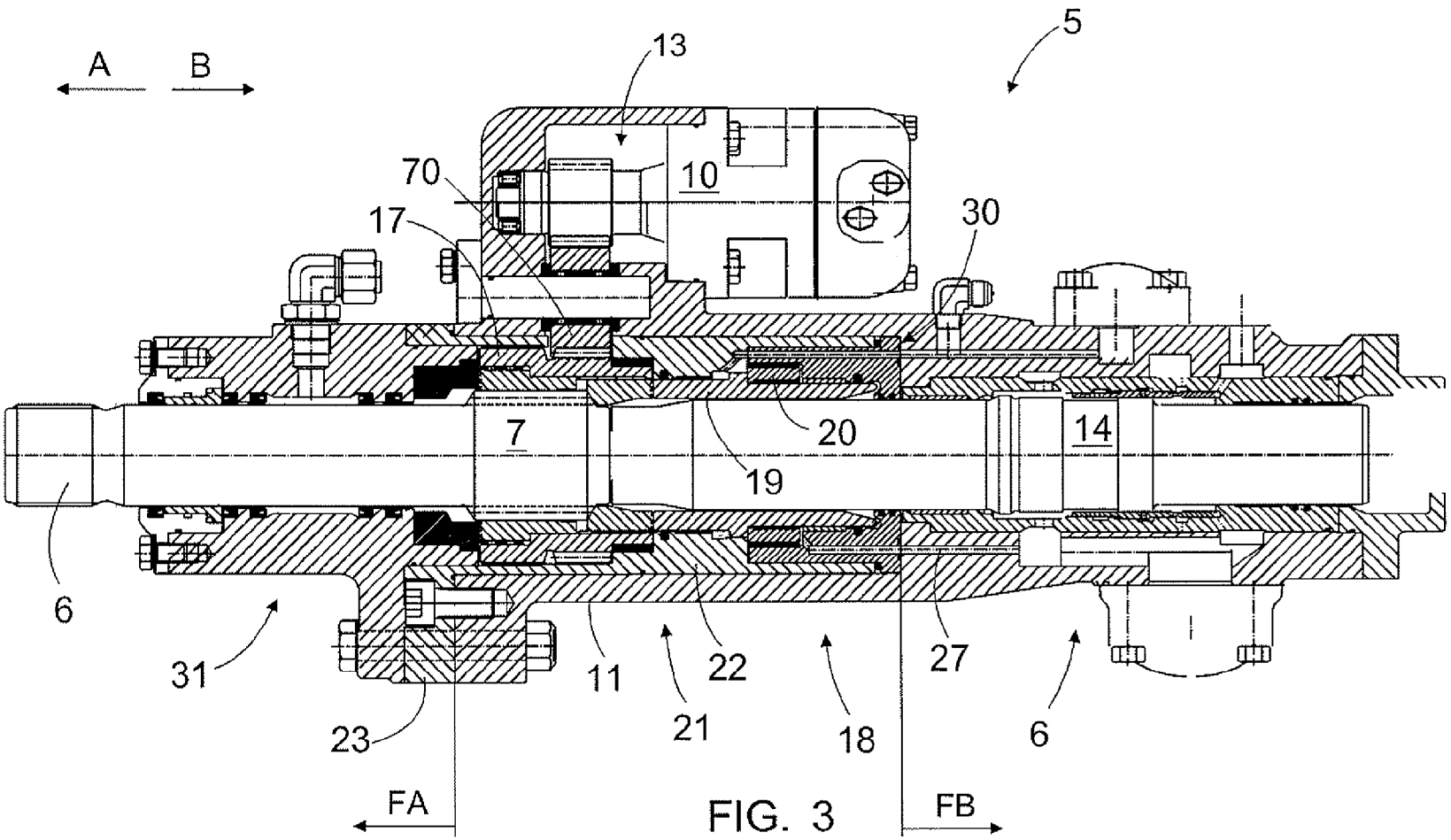
FIG. 3 is a schematic sectional representation of a rock drilling machine equipped with an axial bearing module.

FIGS. 2 and 3 show a sectional view of a rock drilling machine 5. The rock drilling machine 5 may have one body, that is, it may comprise a single uniform body 11. The body 11 may be a tubular piece with a percussion device 6, axial bearing 18, rotating device gear system 13 and drill shank 7 arranged inside it. The percussion device 6 comprises a percussion member 14 that may be a percussion piston arranged to move in the axial direction back and forth by means of a pressure medium so that the impact surface 15 at the front end of the percussion member 14 is arranged to strike the impact surface 16 at the back end of the drill shank 7. It should be mentioned that in this patent application, the front end of the components of the rock drilling machine 5 refers to the stroke-direction A side end and, correspondingly, the back end of the components refer to the return-direction B side end. Surrounding the drill shank 7, there may be a rotating sleeve 17 belonging to the gear system 13 for transmitting the rotation torque provided by the rotating device 10 to the drill shank 7. The connection between the drill shank 7 and rotating sleeve 17 allows the drill shank 7 to move in the axial direction. An intermediate gear 70 may be positioned between the rotating device 10 and rotating sleeve 17.

The axial-direction position of the drill shank 7 may be acted on by an axial bearing 18 that may comprise one, two, or more pistons movable in the axial direction. The drill shank 7 may be supported from its rear side by means of a first axial piston 19. The axial piston 19 may be arranged to act on the drill shank 7 directly or through a support sleeve 90. The first piston 19 may be a sleeve-like piece that may be arranged around the percussion member 14. Further, a sleeve-like second axial piston 20 may be positioned around the first piston 19. The pistons 19 and 20 may be moved in the axial direction relative to each other, when pressure fluid pressure is directed into their pressure chambers. The movement of the second piston 20 in the stroke direction A may be dimensioned shorter than that of the first piston 19. The movement of the first piston 19 in the stroke direction A may be dimensioned so that the impact surface 16 of the drill shank may be moved to be in front of the planned impact point, when feed resistance becomes smaller, whereby a damper in connection with the percussion member 14 may reduce the strike force transmitted to the tool 8 when soft rock is drilled, for instance. Further, the common force of the axial pistons 19, 20 in the stroke direction A may be dimensioned to be greater than the feed force. Alternatively, the force effect of one axial piston alone is dimensioned greater than the feed force. With the axial pistons 19, 20, it is possible not only to influence the axial position of the impact point but also dampen the return movement caused by the stress pulses returning from the rock. When the above-mentioned return movement is directed to the axial pistons 19, 20, the pressure fluid releasing from the pressure chambers of the pistons is led through suitable throttle means to provide the damping. As regards the general operational principle and structure of the axial bearing, we refer to what is stated in publications FI 84 701, FI 20 030 016, and U.S. Pat. No. 6,186,246 and declare that the matters stated therein are also included in this patent application.

In the solution of FIGS. 2 and 3, the axial bearing 18 comprises an axial bearing module 21 mounted inside the body 11 through the front end of the rock drilling machine 5, in other words, the module is front loaded. The axial bearing module 21 may comprise an elongated and in shape essentially sleeve-like first module frame part 22 with a fastening flange 23, shoulder or corresponding support surface on or along its front end, through which it is fastened to the body 11. Further, at the back end of the module frame part 22, there is a cartridge housing 24, into which a second module frame part 25 is arranged; this part, too, being an elongated piece and essentially sleeve-like in shape. In the stroke direction A, the cartridge housing 24 is defined by a shoulder 26, against which the second module frame part 25 is arranged. It is also possible that the fixed shoulder 26 is substituted by a replaceable sealing sleeve. The second module frame part 25 comprises any necessary pressure medium channels 27 for directing the pressure medium into the working pressure chambers 28 of the axial pistons 19, 20 acting in the stroke direction A. The second module frame part 25 forms together with the axial pistons 19, 20, bearings 29, bearing housings, and seals 37 an axial cartridge 30 that is arranged in the cartridge housing 24 before the first module frame part 22 is arranged in the space in the body 11. The axial bearing module 21 formed by the first module frame part 22 and axial cartridge 30 may be conveniently detached as one piece after the flushing chamber 31, drill shank 7, and rotating sleeve 17 at the front end of the rock drilling machine 5, and the intermediate gear 70 are first detached from the front side of the axial bearing module 21. The detachment and installation of the above-mentioned components do not require any special skills or special tools. The body 11 need not be dismantled and, therefore, the rock drilling machine 5 need not be detached from the carriage 36 or the like on the feed beam.

Supporting forces caused by the operation of the axial pistons 19, 20 and acting in the stroke direction are transmitted from the axial cartridge 30 through the axial mating surfaces 81 in the shoulder 26 to the first module frame part 22 and then on through its fastening flange 23 or the like to the body 11. The fastening flange 23 may be fastened with fastening bolts 32 to the body 11. In addition, the fastening bolts 33 or corresponding fastening members of the flushing chamber 31 participate in fastening the first module frame part 22. FIGS. 2 and 3 further show that the pressure medium channels 27 leading to the axial bearing 18 may be axial at least at the point of contact 34 between the axial cartridge 30 and body 11. Owing to this, the pressure medium channels 27 may be furnished with axial seals 35 that seal the channels when the axial bearing module 21 is pushed in place inside the body 11.

The axial cartridge 30 also comprises all other necessary seals 37. When the axial cartridge 30 is replaced, all bearings 29, bearing housings, and seals 37 directly affecting the operation of the axial bearing 18 will also be replaced. FIG. 2 shows that between the shoulder 26 and first piston 19, there may be a seal 37*a*, and between the second module frame part 25 and first piston 19, there may be a seal 37*b*. The seal 37*c* of the percussion member 14 may also be arranged at the axial cartridge 30, in which case its replacement, too, may take place at the time of the axial bearing module 21 replacement. It is clear that the axial bearing 18 may also comprise other seals and that the sealing may be arranged otherwise than shown in FIGS. 2 and 3.

FIG. 2 indicates the points at which the supporting forces caused by the operation of the axial bearing are transmitted to the body 11. Supporting forces FA acting in the stroke direction are transmitted by means of the fastening flange 23 and supporting forces FB acting in the return direction are transmitted by means of the shoulder 74.

In some cases, in the embodiment of FIGS. 2 and 3, it is possible to use a body formed of two or more body parts instead of a one-piece body 11. Then, the point of contact between the body parts is preferably positioned so that the supporting forces caused by the operation of the axial bearing 18 will not pass the point of contact between the body parts. When the point of contact is outside the section between the points FA and FB, it is possible to avoid loading the points of contact and fastening bolts of the body parts.

Figure 4:
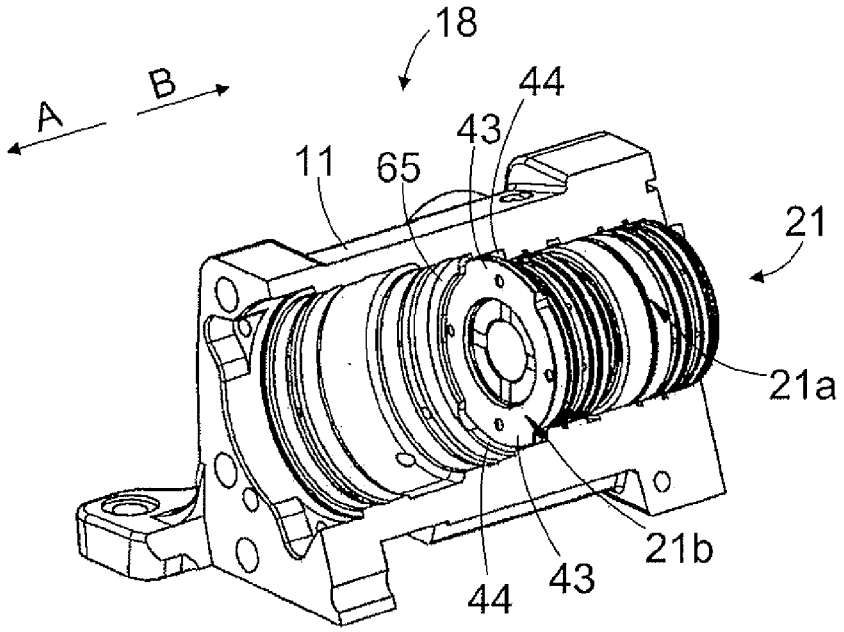
FIGS. 4 to 7 are schematic, sectional, and perspective representations of the structure of an axial bearing module and its installation and locking on to the body of a rock drilling machine.
Figure 5:
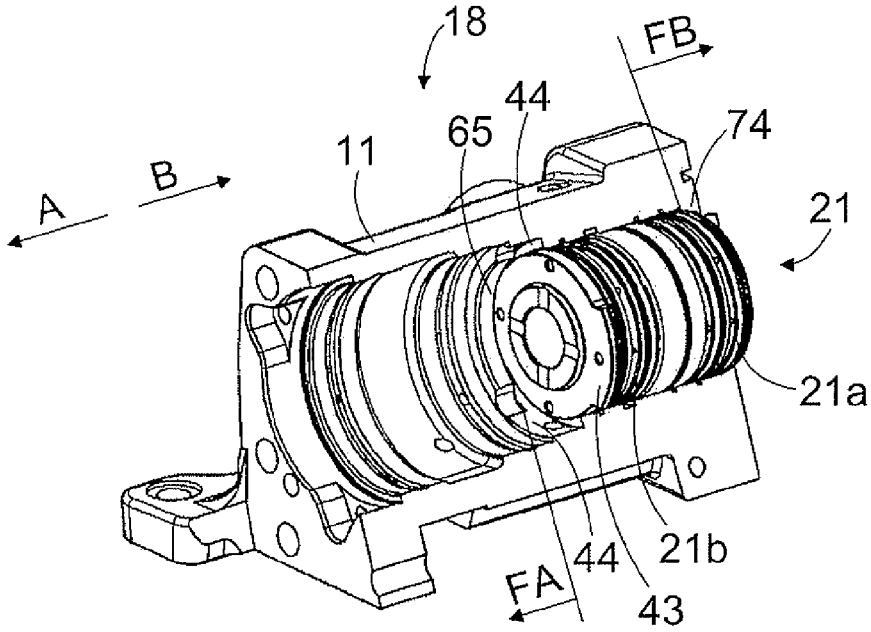

FIGS. 4 to 8 show an alternative axial bearing 18 that comprises a first axial bearing module 21*a* and a second axial bearing module 21*b* that are arranged consecutively in the axial direction inside the body 11 from one installation direction, in this case from the front end of the rock drilling machine 5, after the flushing chamber 31, drill shank 7, rotating sleeve 17 and other possible components in front of the axial bearing 18 have been detached. The body 11 that in FIGS. 4 to 7 is shown only partly for the sake of clarity is at least along the section of the axial bearing 18 a uniform piece with no joint surfaces that the supporting forces caused by the axial bearing 18 could load. As can be seen more clearly in FIG. 8, the first axial bearing module 21*a* comprises a module frame 38*a*, axial piston 39*a*, bearings 40*a*, bearing housings 41*a*, and a seal 42*a*. The first axial bearing module 21*a* may be installed in place and detached in one uniform piece. After the first axial bearing module 21*a* is pushed in place, the second axial bearing module 21*b* may be arranged in the same installation direction in the manner shown in FIG. 4. It is also possible to install and remove the axial bearing modules 21*a* and 21*b* together simultaneously. The second axial bearing module 21*b* correspondingly comprises a module frame 38*b*, axial piston 39*b*, bearing 40*b*, bearing housing 41*b*, and seal 42*b*. Both axial bearing modules 21*a*, 21*b* are thus pieces that are easy to handle, detach and install. As can be seen in FIG. 4, the module frame 38*b* of the second axial bearing module 21*b* may comprise one or more locking brackets 43 that may be pushed inside openings 44 in the body 11 during installation. When the second axial bearing module 21*b* is then turned in the manner shown in FIG. 5 around its longitudinal axis at a limited angle, the locking brackets 43 move away from the openings 44 and lock against the locking surfaces or shoulders 65 on the body 11. The fastening of the second axial bearing module 21*b* may thus be by bayonet locking. Naturally, it is also possible to use other form-locks or separate fastening members. The second axial bearing module 21*b* also locks the first axial bearing module 21*a* in place, whereby the first axial bearing module 21*a* need not necessarily be furnished with fastening members, though this is naturally possible. The supporting forces FA and FB caused by the operation of the axial bearing 18 are transmitted by means of the locking bracket 43 or corresponding fastening means and a shoulder 74 directly to the body 11 of the rock drilling machine.

Figure 6:
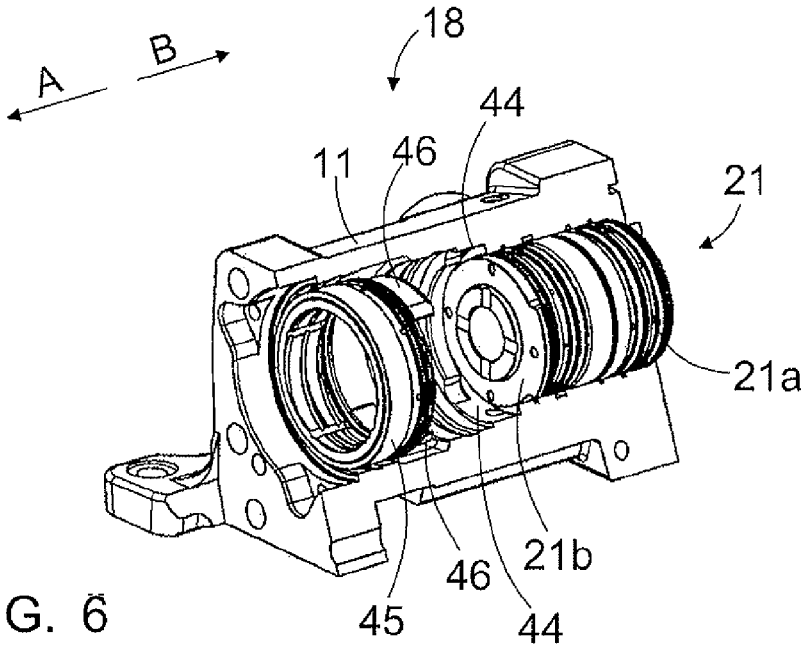
Figure 7:
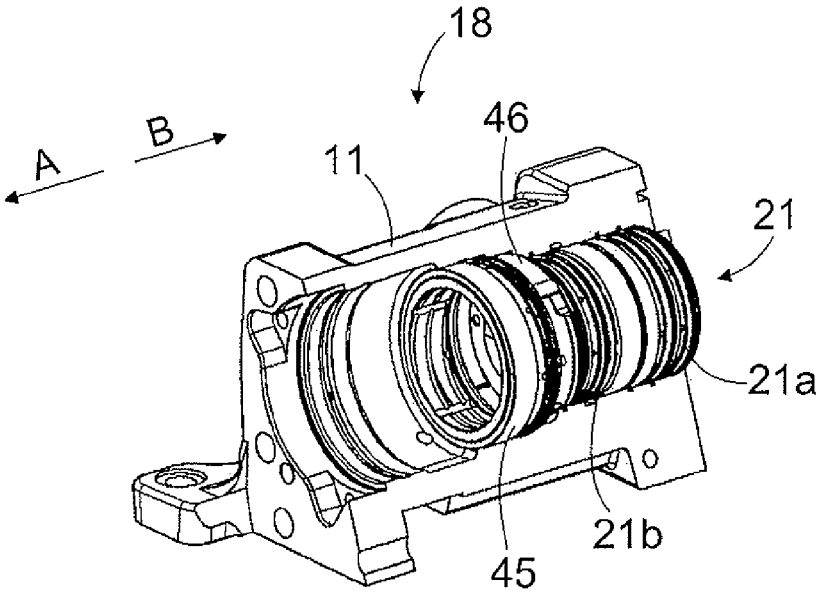
Figure 8:
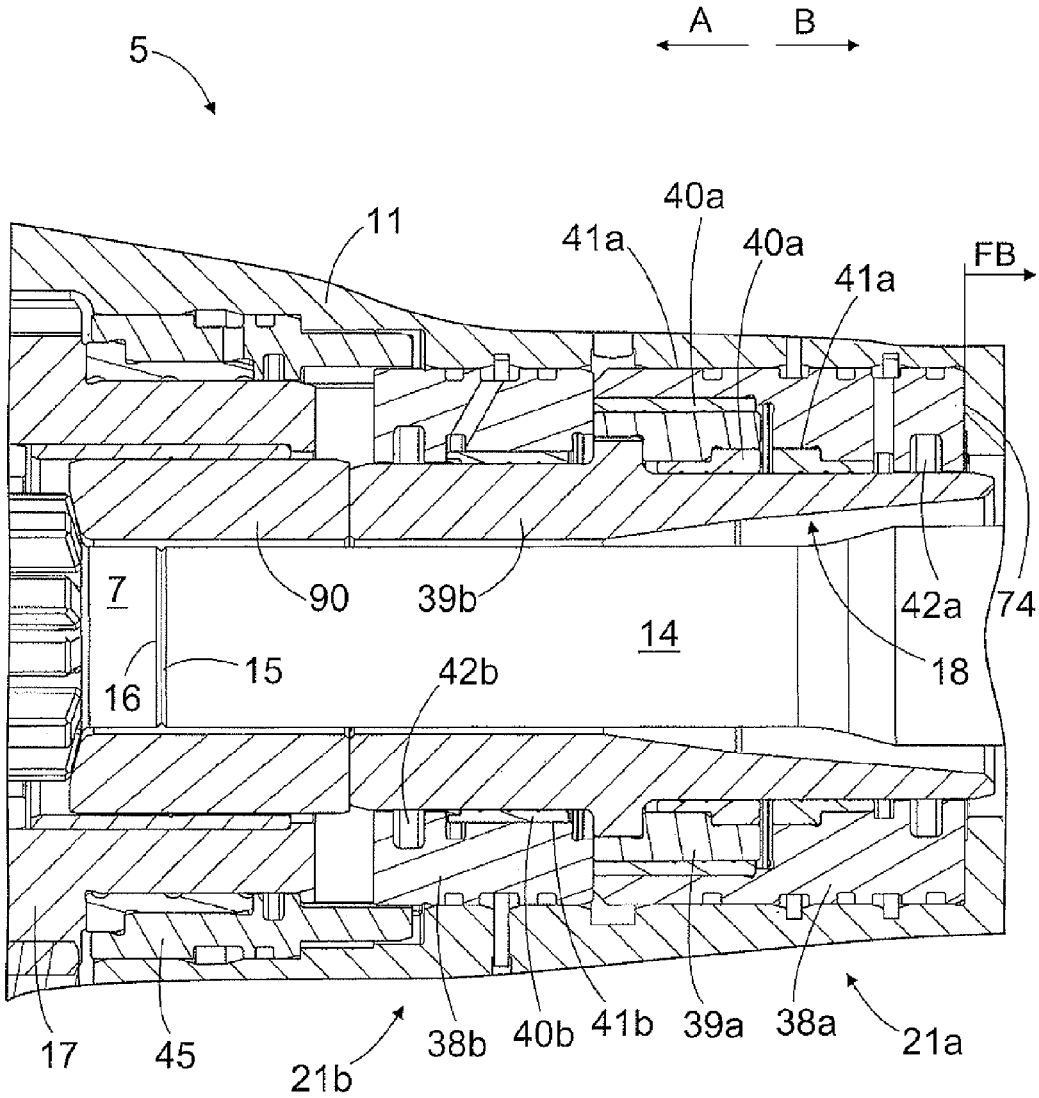
FIG. 8 is a schematic and sectional representation of a rock drilling machine that is equipped with the axial bearing module of FIGS. 4 to 7, FIGS. 9 and 10 are schematic and sectional representations of some arrangements for pretensioning the axial bearing module for the axial feed channel of the pressure medium.

FIGS. 6 and 7 show that the rotation of the second axial bearing module 21*b* around its longitudinal axis may be prevented with a bearing sleeve 45. The bearing sleeve 45 may comprise axial-direction brackets 46 at the openings 44 in the body 11. When the bearing sleeve 45 is pushed in place in the axial direction, the brackets 46 push into the openings 44 and lock the second axial bearing module 21*b* against turning. In the cross-sectional view of FIG. 8, this locking arrangement is not visible. The bearing sleeve 45 may comprise a bearing for fitting the rotating sleeve 17 with bearings.

One embodiment of the axial bearing 18 shown in FIGS. 4 to 8 may be one with only one axial bearing module 21. Further, another embodiment may comprise one or two axial bearing modules 21*a*, 21*b* that are mounted in the space in the body 11 through the back end of the rock drilling machine 5, that is, breech-loaded. Further, both axial bearing modules 21*a*, 21*b* may be equipped with their own support surfaces for transmitting supporting forces to the body of the rock drilling machine. It is also possible that the axial bearing module comprises two axial pistons and two module frame parts that may be detached from each other for arranging the axial piston, and thereafter fastened together into one uniform piece that may be arranged in place in the cartridge housing or corresponding space in the body 11. Yet another possibility is that the bearing sleeve 45 comprises locking surfaces for transmitting the supporting forces to the body 11.

Figure 9:
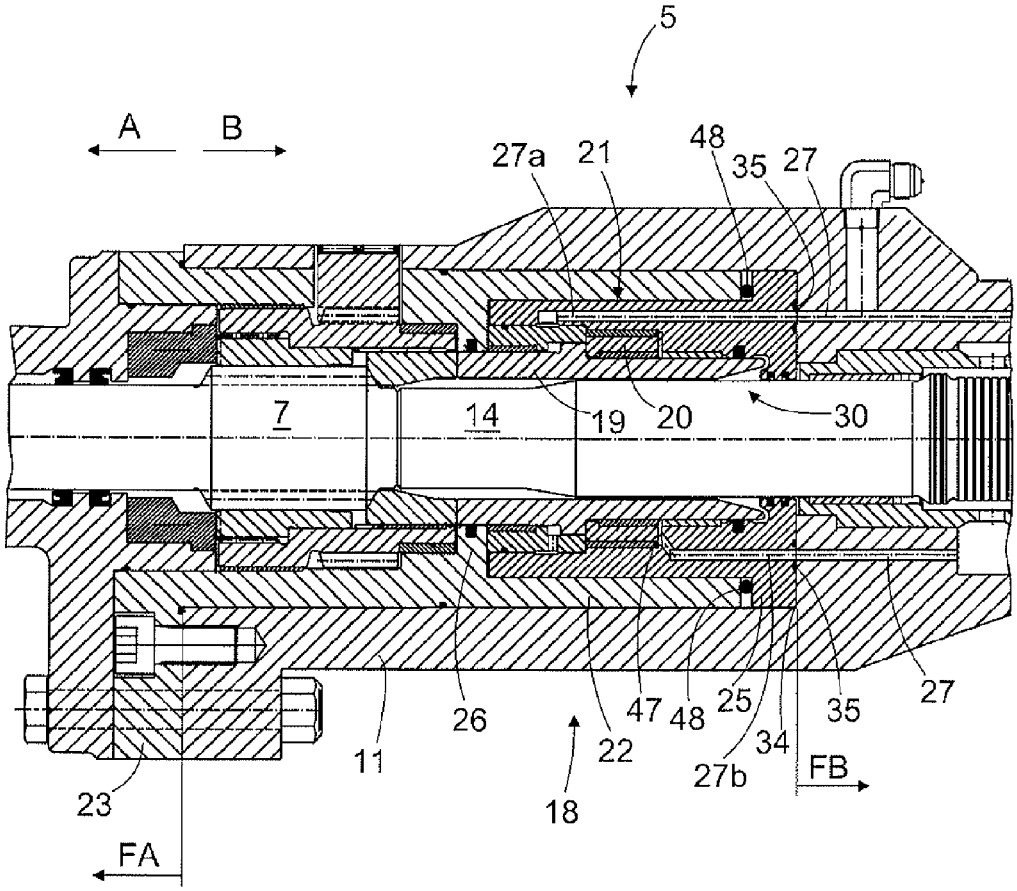

The rock drilling machine shown in FIG. 9 comprises an axial bearing module 21 of the type shown in FIGS. 2 and 3. The pressure channels 27 extending from the body 11 to the axial bearing module 21 are arranged to cross the point of contact 34 between the module 21 and body 11 in the axial direction, whereby there may be axial seals 35 between the connecting channel sections 27, 27*a*, and 27*b*. When the rock drilling machine 5 is pressurised and pressure medium is led from the pressure medium channel 27*b* to a pressure chamber between the second axial piston 20 and second module frame 25, where there is a pressure surface 47 acting in the return direction B, a force is formed therein that tries to push the second module frame 25 in the return direction B against the body 11 with the result that the axial seals 35 at the point of contact 34 press tightly against the sealing surfaces. Further, between the first module frame 22 and the second module frame 25, there may be an axial spring member 48 that continuously presses the axial cartridge 30 against the body 11. The axial spring member 48 may be for instance an o-ring or corresponding piece made of compressible elastic material. Alternatively, it may be a metal spring.

Figure 10:
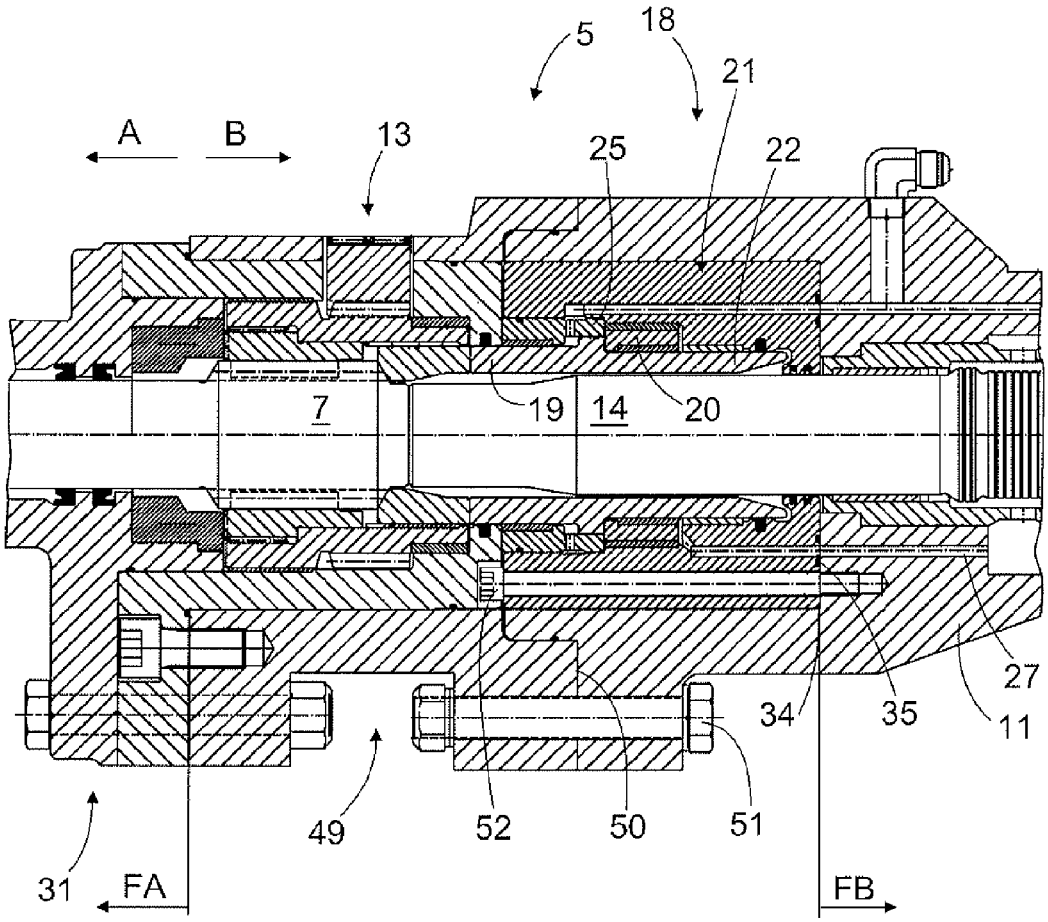

FIG. 10 shows a rock drilling machine 5, the body 11 of which may be a uniform piece along the section of the axial bearing, but in which the drill shank 7 and gear system 13 associated with it are arranged in their own gearbox 49 that is arranged against a joint surface 50 in the front part of the body 11 and fastened with fastening bolts 51 or the like. The axial bearing module 21 is arranged in the space in the front part of the body 11 after the flushing chamber 31 and the rotating components of the gear system 13 have been detached. However, the gearbox 49 need not be detached. The axial module 21 may be removed and installed through the front end of the rock drilling machine 5 without needing to open the joint surface 50 between the gearbox 49 and body 11. The axial bearing module 21 may be pressed with a pretension screw 52 against the body 11 in the return direction B, whereby the axial seals 35 at the connecting points of the pressure medium channels 27 achieve good sealing. The embodiment shown in FIG. 10 may also comprise features shown in other figures of this patent application.

Figure 11:
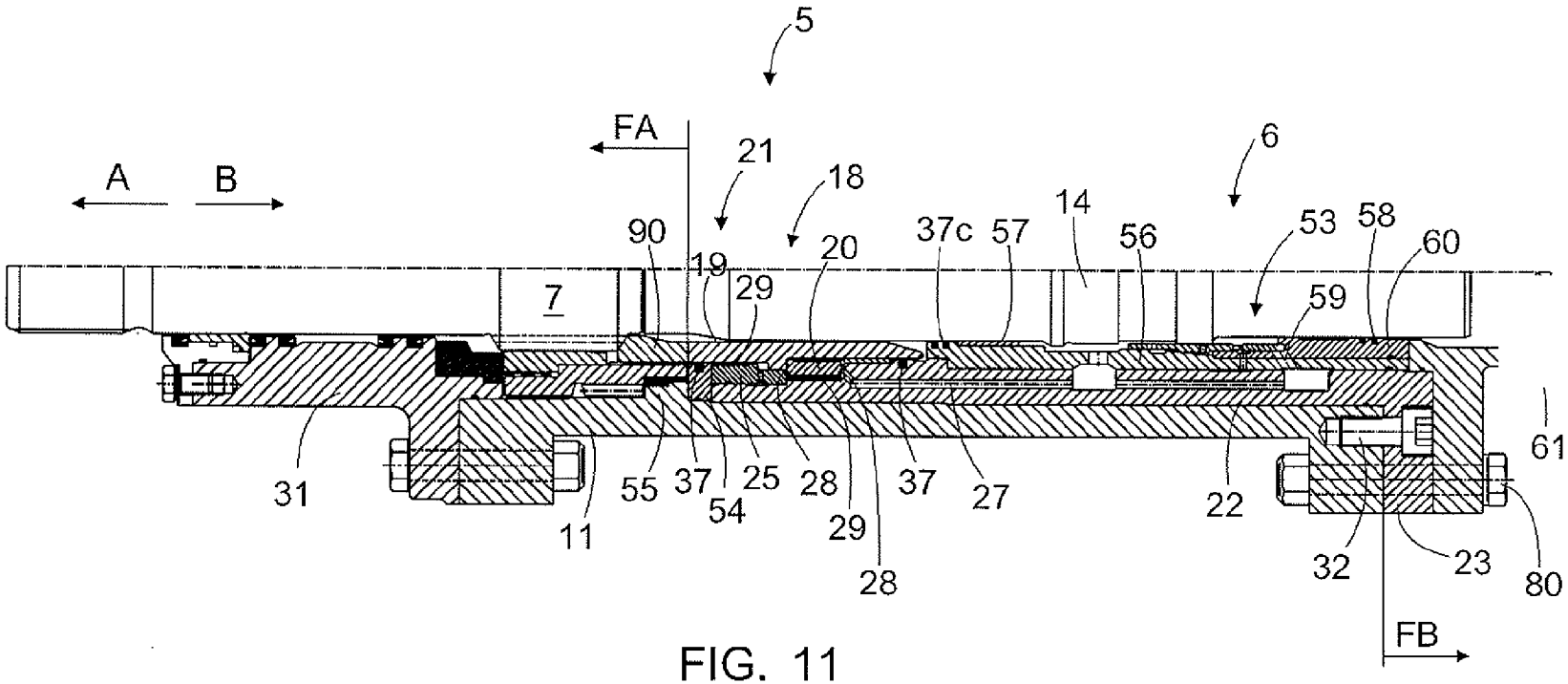
FIG. 11 is a schematic, sectional, and partial representation of a rock drilling machine equipped with a breech-loading percussion device module and axial bearing module.

FIG. 11 shows a rock drilling machine 5 that comprises a breech-loaded axial bearing module 21 and percussion device module 53. The back end of the body 11 has a space or cartridge housing, to which the axial bearing module 21 and percussion device module 53 are arranged within each other. The modules 21, 53 may be detached and installed after the pressure accumulator 61 belonging to the percussion device 6 is first detached. When there is no pressure accumulator or it is positioned elsewhere, there is instead a back cover or some other drilling machine back component which is then detached to obtain access to the modules. The modules 21, 53 may thus be installed in the space reserved for them inside the body 11 from one installation direction. The body 11 of the rock drilling machine 5 may be a one-part piece, as shown in the figure, or in some cases it may comprise two or more body parts attached to each other with a joint so positioned that the supporting forces caused by the axial bearing 18 will not load the joint. The axial bearing module 21 may comprise a first module frame part 22 having along the section of its back end a fastening flange 23, shoulder or the like with which it may be fastened to the body 11. The supporting forces caused by the axial bearing 18 may be transmitted by means of the fastening flange 23 directly to the body 11. The axial bearing module 21 may have in its front part a sealing sleeve 54 that may comprise a seal 37 for sealing the first axial piston 19. Further, the body 11 may have a shoulder 55 which limits the cartridge housing and against which the axial bearing module 21 may be supported in the stroke direction A. The percussion device module 53 is arranged inside the back part of the first module frame part 22, and between the two, there may be the necessary seals. The percussion device module 53 comprises a percussion module frame 56 that may be a sleeve-like elongated piece. In addition, the percussion device module 53 may comprise the required bearings 57, seals 58, pressure medium channels 59, and percussion member 14. The back part of the percussion device module 53 may have a seal sleeve 60. When the pressure accumulator 61 or back cover has been detached by opening the fastening bolts 80, it is then possible to detach only the percussion module 53, if desired, for replacing the seals of the percussion member 14, for instance. Further, the fastening bolts 32 of the axial bearing module 21 may be opened and the axial bearing module 21 pulled out together with the percussion device module 53 in one piece from the cartridge housing in the body 11. After this, the sealing sleeve 60 may be detached and the percussion member 14 and percussion device module 53 pulled out of the axial bearing 21.

The stroke-direction supporting forces FA caused by the operation of the axial bearing 18 are transmitted by means of the shoulder 55 to the body 11, and the return-direction supporting forces FB are transmitted by means of the fastening flange 23 to the body 11, as illustrated in FIG. 11.

FIG. 11 shows an embodiment in which the percussion device module 53 is arranged inside the axial bearing module 21. An alternative solution is to arrange the modules 21 and 53 one after the other in the axial direction so that that axial bearing module 21 is in front of the percussion device module 53 as seen in the stroke direction A. The axial bearing module 21 may then be fastened either by its own fastening members and support surfaces to the body 11 or it may be fastened and supported to the body 11 by means of the fastening and support surfaces of the percussion device module 53. Further, in the joint surface between the modules 21, 53, there may be axial-direction pressure medium channels equipped with axial seals. The pressure medium channels then connect and seal automatically to each other when the modules 21, 53 are pushed in place.

Figure 12:
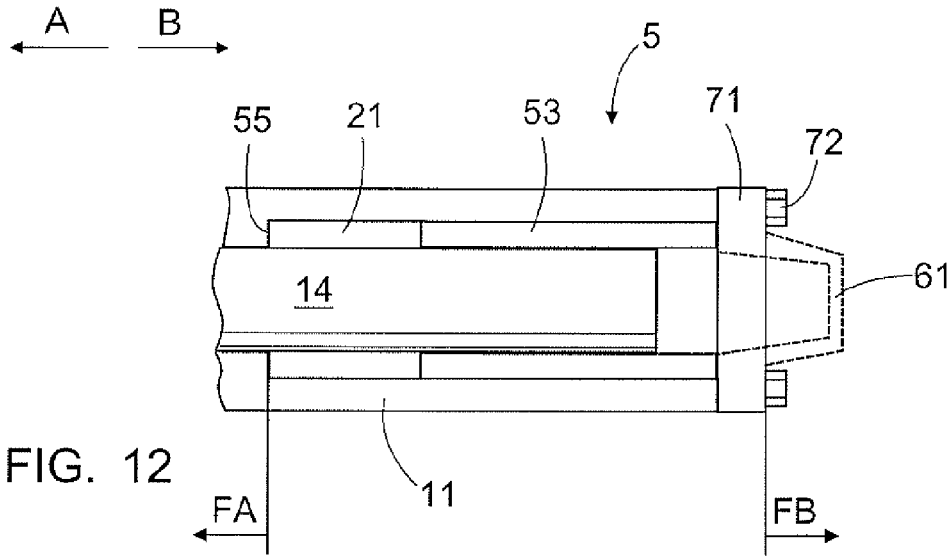
FIG. 12 is a schematic representation of the back end of a rock drilling machine equipped with a back-mounted axial bearing module and percussion device module, and where a back component receives supporting forces.

FIG. 12 shows the back part of a rock drilling machine 5 having a back cover 71, percussion device module 53, and axial bearing module 21 one after the other. The modules 53 and 21 are loaded in place from the back. The axial bearing module 21 is supported in the stroke direction A against a shoulder 55 on the body 11. The stroke-direction supporting forces FA caused by the operation of the axial bearing are then transmitted to the body 11 through the shoulder 55. The percussion device module 53 is supported from its back part to the body 11 by means of the back cover 71 and bolts 72. The back cover 71 and its fastening are dimensioned to be so strong that they are capable of transmitting the return-direction supporting forces FB caused by the operation of the axial bearing to the body 11. Alternatively, the percussion device module 53 may be supported by means of a pressure accumulator 61 or the like indicated with dashed lines instead of the back cover 71. In this solution, too, the supporting forces caused by the operation of the axial bearing do not in any way strain the critical structure of the front end of the rock drilling machine.

Figure 13:
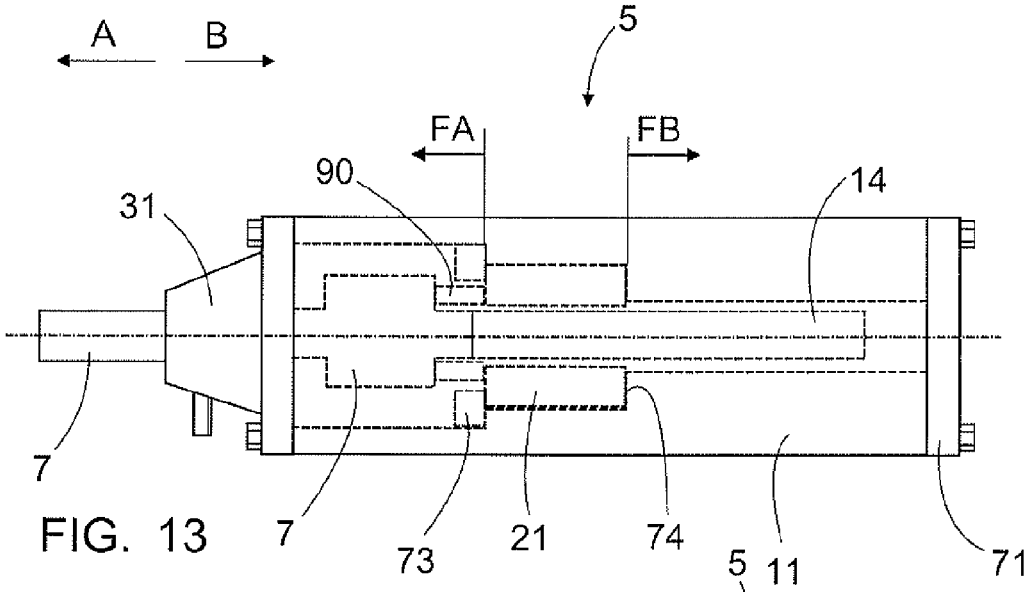
FIG. 13 is a schematic and highly simplified representation of the structure of a rock drilling machine, in which the axial bearing module is supported in the return direction by means of a shoulder and in the stroke direction by means of a separate locking piece.

FIG. 13 shows an embodiment in which the axial bearing module 21 is installed in place from the front and locked in the stroke direction A by means of a specific locking piece 73, such as a locking sleeve, which may be fastened in the axial direction relative to the body 11. The stroke-direction supporting forces FA caused by the operation of the axial bearing are then received by means of the locking piece 73 and the return-direction supporting forces FB are received by means of the shoulder 74 to the body 11.

Figure 14:
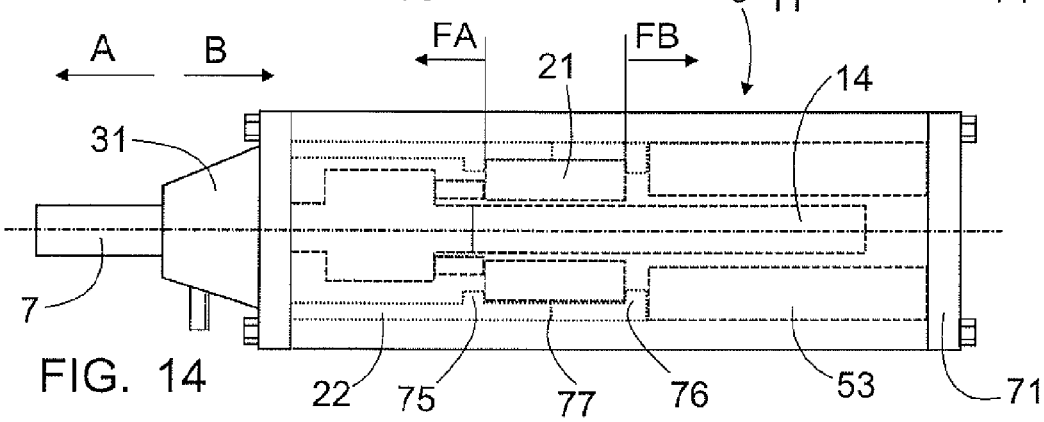
FIG. 14 is a schematic and highly simplified representation of an embodiment in which a sleeve-like module frame surrounding the axial bearing module receives both the stroke-direction and return-direction supporting forces.

FIG. 14 shows an embodiment in which the axial bearing module 21 is supported by means of the sleeve-like module frame 22 in both the stroke direction A and return direction B. For support, the module frame 22 has shoulders 75, 76 or corresponding support surfaces that receive the supporting forces FA and FB caused by the operation of the axial bearing. For installing the axial bearing module 21, the module frame 22 may consist of two inter-connectable and detachable pieces with a threaded connection 77, bayonet connection or the like between them. In this embodiment, the body 11 of the rock drilling machine may comprise a point of contact at the axial bearing 18 without having the joint strained by the supporting forces FA and FB.

The axial bearing modules shown in FIGS. 12 to 14 are installable from one installation direction in one piece, and the supporting forces caused by their operation are received without causing any strain to the critical front part of the rock drilling machine and especially the flushing chamber.

Figure 15:
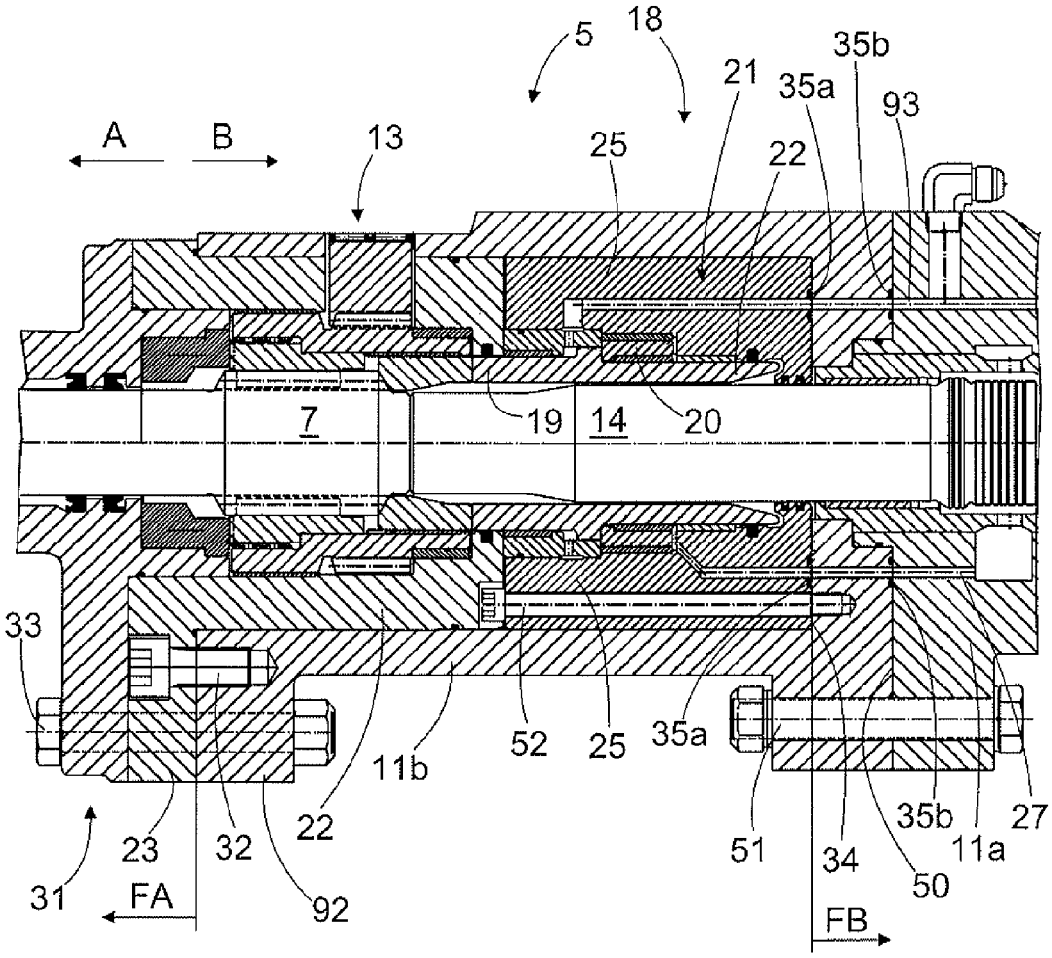
FIG. 15 is yet another schematic and sectional representation of an embodiment of the solution according to FIG. 10.

FIG. 15 shows an embodiment of the solution according to FIG. 10. The rock drilling machine 5 comprises a basic body, that is, a first body part 11*a*, against a joint surface 50 in the front part of which a second body part 11*b* is arranged. The body parts 11*a* and 11*b* may be fastened to each other with fastening bolts 51. The axial bearing 18 is positioned at the second body part 11*b*. The supporting forces FA and FB caused by the operation of the axial bearing are transmitted to the second body part 11*b* and by means of it on to the basic body, that is, the first body part 11*a*. The second body part 11*b* is a uniform piece with no joint surfaces between points FA and FB. The uniform second body part 11*b* is therefore capable of receiving the supporting forces FA and FB acting in opposite directions. At the front end of the second body part 11*b*, there may be a flange or corresponding support surface 92, to which the first module frame part 22 may be supported and fastened with fastening bolts 32. The axial bearing module 21 is arranged in a space in the second body part 11*b* after the flushing chamber 31 and the rotating components of the gear system 13 have been detached. The axial module 21 may be removed and installed through the front end of the rock drilling machine 5 without needing to open the joint surface 50 between the second body part 11*b* and first body part 11*a*. The axial bearing module 21 may be pressed by means of the pretension screw 52 against the joint surface 34 of the second body part 11*b* in the return direction B, whereby the axial seals 35*a* at the connection points of the axial pressure medium channels 27 and 93 achieve a good sealing. The joint surface 50 may also have axial seals 35*b* that seal the channels 27 and 93 when the body parts 11*a* and 11*b* are pressed against each other by the fastening bolts 51. Otherwise, the embodiment shown in FIG. 15 may comprise features shown in other figures of this patent application.

It should be mentioned that the module frame may be equipped with a bearing that is made of bearing metal, such as bearing bronze, and arranged in the module frame by welding or casting, for instance. The module frame then does not have an actual bearing housing for the separate bearing member, but it has a type of integrated structure. Further, it is possible to form the required bearing surfaces by using a suitable coating. The bearing surface of the axial bearing module may thus be formed of a separate bearing piece, a slide bearing integrated to the module frame, or a bearing coating.

In some cases, the features disclosed in this patent application may be used as such, regardless of other features. On the other hand the features disclosed in this patent application may, when necessary, be combined to form various combinations.

The drawings and the related description are only intended to illustrate the idea of the invention. The invention may vary in detail within the scope of the claims.

The invention claimed is:

1. A rock drilling machine that comprises:

a body, a percussion device that comprises a percussion element for generating stress pulses, a drill shank that is an elongated piece arranged in front of the percussion element in the stroke direction, the drill shank having an impact surface for receiving said stress pulses and, further, the drill shank being movable in the axial direction relative to the body, a flushing chamber located in the front part of the rock drilling machine to feed flushing medium to the drill shank, an axial bearing that comprises at least one pressure medium-operated axial piston which pushes the drill shank in the axial direction relative to the body a predefined travelling length toward the stroke direction (A), whereby the impact surface of the drill shank is settable at a required axial point for receiving stress pulses, and wherein the flushing chamber is located separate from the axial bearing, wherein the axial piston comprises at least one working pressure surface located in at least one working pressure space belonging to the axial bearing, to which the pressure of pressure medium is fed from at least one feed channel, whereby a force in the stroke direction is directable to the axial piston, and the axial bearing comprises at least one axial bearing module that comprises at least one axial piston, at least one seal, at least one bearing surface, and a module frame, said axial bearing module is detachable and installable in place in one piece without dismantling the body of the rock drilling machine, and wherein at least one set of support members is in connection with the axial bearing for transmitting supporting forces caused by the axial bearing to the body of the rock drilling machine without any force effects directed to the flushing chamber.

2. The rock drilling machine as claimed in claim 1, wherein the body of the rock drilling machine is at least at the axial bearing a uniform piece without any joint surfaces.

3. The rock drilling machine as claimed in claim 1, wherein the axial bearing comprises at least one first axial piston and at least one second axial piston having different lengths of travel in the stroke direction.

4. The rock drilling machine as claimed in claim 1, wherein the axial piston is a sleeve-like piece arranged around the percussion element.

5. The rock drilling machine as claimed in claim 1, wherein the module frame comprises at least one set of support members that locks directly to the body of the rock drilling machine, whereby said module frame is arranged to transmit the axial supporting forces caused by the axial bearing and acting in the stroke direction directly to the body of the rock drilling machine.

6. The rock drilling machine as claimed in claim 1, wherein the module frame comprises at least one set of support members that are lockable directly to the body of the rock drilling machine, whereby said module frame is arranged to transmit the axial supporting forces caused by the axial bearing and acting in the stroke direction directly to the body of the rock drilling machine, the module frame has at least one locking bracket, the body of the rock drilling machine has at least one locking shoulder, and said locking bracket is arranged to lock into said locking shoulder after the axial bearing module has been pushed in place in the axial direction and turned around its longitudinal axis at a limited angle, whereby the movement of the module frame in the stroke direction is prevented with a bayonet-type fastening.

7. The rock drilling machine as claimed in claim 1, wherein the axial bearing module is detachable and installable in place in one piece from the direction of the drill shank without dismantling the body of the rock drilling machine.

8. The rock drilling machine as claimed in claim 1, wherein the axial bearing module is detachable and installable in place in one piece from the direction of the drill shank without dismantling the body of the rock drilling machine, the module frame comprises a first module frame part and a second module frame part, the first module frame part is an elongated essentially sleeve-like piece that on the drill shank side section has at least one fastening flange and on the percussion device side section has a cartridge housing, in connection with said fastening flange, there are means for transmitting at least the axial forces acting toward the stroke direction from the first module frame part directly to the body of the rock drilling ma-chine, a second module frame part is arranged in said cartridge housing, which together with all axial pistons and the bearing surfaces belonging to the axial bearing form an axial bearing cartridge, and between the cartridge housing and axial bearing cartridge, there is at least one set of axial mating surfaces for transmitting axial forces acting in the stroke direction from the axial bearing cartridge to the first module frame part.

9. The rock drilling machine as claimed in claim 1, wherein the axial bearing module is detachable and installable in place in one piece from the opposite direction to the drill shank.

10. The rock drilling machine as claimed in claim 1, wherein the axial bearing module is detachable and installable in place in one piece from the opposite direction to the drill shank, the axial bearing module comprises a sleeve-like first module frame part and a sleeve-like second module frame part, the second module frame part is arranged inside the first module frame part, and the first module frame part comprises in its back end section at least one set of support surfaces for transmitting the forces caused by the operation of the axial bearing to the body of the rock drilling machine.

11. The rock drilling machine as claimed in claim 1, wherein the axial bearing module is detachable and installable in place in one piece from the opposite direction to the drill shank, the axial bearing module comprises a sleeve-like first module frame part and a sleeve-like second module frame part, the second module frame part is arranged inside the first module frame part, the first module frame part comprises in its back end section at least one set of support surfaces for transmitting the forces caused by the operation of the axial bearing to the body of the rock drilling machine, the axial bearing comprises a percussion device module having a percussion element, sleeve-like percussion module frame, at least one bearing, at least one seal, and at least one pressure medium channel, and the percussion device module is arranged inside the axial bearing module.

12. The rock drilling machine as claimed in claim 1, wherein the axial bearing module is detachable and installable in place in one piece from the opposite direction to the drill shank, the axial bearing module comprises a sleeve-like first module frame part and a sleeve-like second module frame part, the second module frame part is arranged inside the first module frame part, and the first module frame part comprises in its back end section at least one set of support surfaces for transmitting the forces caused by the operation of the axial bearing to the body of the rock drilling machine, the axial bearing comprises a percussion device module having a percussion element, sleeve-like percussion module frame, at least one bearing, at least one seal, and at least one pressure medium channel, and the percussion device module and axial bearing module are arranged one after the other in the axial direction.

13. The rock drilling machine as claimed in claim 1, wherein all axial pistons and bearing surfaces belonging to the axial bearing are integrated into one entity in the axial bearing module.

14. The rock drilling machine as claimed in claim 1, wherein the at least one feed channel leading to the working pressure space of the axial piston comprises converging axial-direction sections at least at the point of contact between the axial bearing module and body of the rock drilling machine, and at said point of contact, at least one axial seal at the feed channel sections.

15. The rock drilling machine as claimed in claim 1, wherein the at least one feed channel leading to the working pressure space of the axial piston comprises converging axial-direction sections at least at the point of contact between the axial bearing module and body of the rock drilling machine, at said point of contact, there is at least one axial seal at the feed channel sections, the axial bearing module is equipped with at least one pressure surface to which pressure medium is arranged to be led to generate an axial force acting in the direction towards the percussion device, and said axial force is arranged to push the axial bearing module against the body of the rock drilling machine, whereby the axial seal at the point of contact is arranged to compress between the axial bearing module and body and is thus arranged to seal the feed channel at the point of contact.

16. The rock drilling machine as claimed in claim 1, wherein the at least one feed channel leading to the working pressure space of the axial piston comprises converging axial-direction sections at least at the point of contact between the axial bearing module and body of the rock drilling machine, at said point of contact, there is at least one axial seal at the feed channel sections, the axial bearing module is equipped with pretension means for keeping said axial seal continuously compressed at the point of contact.

17. The rock drilling machine as claimed in claim 1, wherein the body is a single uniform piece.

18. The rock drilling machine as claimed in claim 1, wherein the axial bearing comprises at least a percussion device module having a percussion element, sleeve-like percussion module frame, at least one bearing surface, at least one seal, and at least one pressure medium channel, the percussion device module and axial bearing module are arranged in a space in the back part of the body one after the other in the axial direction, the installation taking place from the back, the axial bearing module that is first in the stroke direction is supported against a shoulder in the body, the percussion device module that is located behind is supported to the body by means of a back component, and the stroke-direction supporting forces caused by the operation of the axial bearing are arranged to be received by the shoulder and, correspondingly, the return-direction supporting forces by means of the back component.

19. An axial bearing module of a rock drilling machine, which comprises at least one pressure medium-operated axial piston which pushes a drill shank of the rock drilling machine in the axial direction relative to a body of the rock drilling machine a predefined travelling length toward a stroke direction, whereby an impact surface of the drill shank is settable at a required axial point for receiving stress pulses, wherein the axial bearing module comprises at least one axial bearing, at least one seal, at least one bearing surface, and a module frame, wherein the module frame comprises at least one set of support members for fastening the axial bearing module independently to the rock drilling machine, wherein the at least one set of support members are lockable directly to the body of the rock drilling machine, whereby said module frame is arranged to transmit the axial supporting forces caused by the axial bearing and acting in the stroke direction directly to the body of the rock drilling machine, wherein the module frame has at least one locking bracket and the body of the rock drilling machine has at least one locking shoulder, said locking bracket arranged to lock into said locking shoulder after the axial bearing module has been pushed in place in the axial direction and turned around its longitudinal axis at a limited angle, whereby the movement of the module frame in the stroke direction is prevented with a bayonet-type fastening, and wherein the axial bearing module is a uniform piece that is detachable and installable in place in one piece to the rock drilling machine.

20. The axial bearing module as claimed in claim 19, wherein the module frame is an elongated sleeve-like piece, and the axial bearing module includes a fastening flange along one end of the module frame.

21. The axial bearing module as claimed in claim 19, wherein the module frame is a sleeve-like piece and comprises at least one locking bracket on its outer rim.

* * * * *